United States Patent [19]

Lowder

[11] 4,222,145

[45] Sep. 16, 1980

[54] VACUUM CLEANER CARRIAGE AND TANK ASSEMBLY

[75] Inventor: Dale E. Lowder, North Muskegon, Mich.

[73] Assignee: Clarke-Gravely Corporation, Muskegon, Mich.

[21] Appl. No.: 847,905

[22] Filed: Nov. 2, 1977

[51] Int. Cl.[3] ..... B62B 3/08

[52] U.S. Cl. ..... 15/353; 15/323; 248/129; 248/137; 280/47.2; 280/47.26; 280/47.34

[58] Field of Search ..... 15/352, 353; 248/128, 248/129, 130, 133, 134, 135, 137, 138, 139, 141; 280/47.12, 47.2, 47.26, 47.34, 293, 297

[56] References Cited

U.S. PATENT DOCUMENTS

| | | | |
|---|---|---|---|
| 1,559,792 | 11/1925 | Seabold | 248/129 |
| 1,937,668 | 12/1933 | Pine | 248/129 |
| 2,643,732 | 6/1953 | Keen | 15/352 X |
| 2,719,596 | 10/1955 | Kent et al. | 15/300 A X |
| 2,876,484 | 3/1959 | Wells | 15/354 |
| 2,914,791 | 12/1959 | Wells | 15/345 |
| 3,063,082 | 11/1962 | Rosenberg | 15/327 |
| 3,550,181 | 12/1970 | Dolan et al. | 15/320 |
| 3,903,565 | 9/1975 | Hicks | 15/352 |
| 3,930,630 | 1/1976 | Wulff | 248/129 |
| 3,942,217 | 3/1976 | Bates | 15/352 X |

FOREIGN PATENT DOCUMENTS

| | | | |
|---|---|---|---|
| 2040910 | 2/1972 | Fed. Rep. of Germany | 15/352 |

*Primary Examiner*—Christopher K. Moore

*Attorney, Agent, or Firm*—Price, Heneveld, Huizenga & Cooper

[57] ABSTRACT

A vacuum cleaning apparatus is disclosed in which a wheeled carriage supports a plurality of different size collection tanks on a pivot support rod extending between upward extending portions of a handle frame mounted on the carriage base. The rear of each of the tanks includes a transverse groove dimensioned to slip onto the pivot support rod. The tanks may be pivoted about the support rod to dump the contents contained therein. A carriage anti-tilt support, pivotally mounted on the carriage, prevents tipping of the carriage during tank dumping.

20 Claims, 13 Drawing Figures

VACUUM CLEANER CARRIAGE AND TANK ASSEMBLY

BACKGROUND OF THE INVENTION

This invention relates to vacuum cleaners of the wet/dry type and more particularly to tanks for such cleaners and a wheeled carriage which permits the tanks to be detachably supported on the carriage yet pivotable relative thereto for dumping the contents contained within the tank.

Various forms of wet/dry vacuum cleaning apparatus are presently available. These apparatus generally include a debris collection tank. The tank is typically open at its top end and is adapted to support a suction head which carries a blower. A suitable inlet is provided either in the tank or in the suction head which is connectable to a flexible hose. The blower creates suction in the hose for cleaning purposes. These vacuum cleaners are capable of removing dry material from the surface to be cleaned or sucking liquids such as water into the collection tank. An example of one such prior art wet/dry vacuum cleaner may be found in U.S. Pat. No. 2,719,596 entitled VACUUM CLEANER and issued on Oct. 4, 1955 to M. A. Kent et al. The vacuum cleaner disclosed in this patent includes a collection tank and a suction head. The collection tank is supported upon a wheeled carriage. In order to empty the tank, a draw off valve is provided permitting from one-fourth to one-third of the contents to be drawn off. In order to fully empty the tank, it must be removed from the support carriage.

Various proposals have been made to permit complete emptying of the tank without fully removing it from the support carriage. These devices permanently or semi-permanently pivotally support the tank on the carriage to permit it to be tilted and emptied into a suitable drain after removal of the suction head. An example of one such tilting arrangement may be found in U.S. Pat. No. 3,063,082 entitled SUCTION CLEANER and issued on Nov. 13, 1962 to E. N. Rosenberg. The tilting arrangement disclosed in this patent, however, employs a yoke member pivotally mounted to the stand. The yoke member is permanently or semi-permanently secured to the tank by bolts, rivets or by welding the yoke to the tank. Therefore, this structure permits the carriage to be employed only with a single size tank and does not permit the ready removal of the tank from the carriage.

Another example of a tiltable tank support may be found in U.S. Pat. No. 3,930,630 entitled VACUUM CLEANER SUPPORT APPARATUS and issued on Jan. 6, 1976 to Richard F. Wulff. The apparatus disclosed in this patent includes a wheeled carriage, a pair of vertical uprights and a pair of arms pivotally mounted to the uprights and bolted or riveted to the collection tank of the vacuum cleaner. A handle is provided for tilting the arms and hence the tank to permit dumping of the collection tank. As with the aforementioned Rosenberg patent, the collection tank is for all practical purposes permanently secured to the carriage.

With the presently available tiltable tank and carriage assemblies, other problems have been experienced with dumping of the contents of the tank. Unless the front of the carriage is held down as the tank is pivoted, the carriage will pivot about the rear wheel axles and tip over. As the tank is pivoted, the center of gravity of the apparatus shifts to a point above the axles of the rear wheels thereby exerting a turning movement on the carriage resulting in the carriage tipping over on its back.

In general, prior art devices lack versatility, are cumbersome and costly to produce in a variety of sizes.

SUMMARY OF THE INVENTION

Essentially, the vacuum cleaning apparatus of the present invention includes a wheeled base defining a platform and a collection tank adapted to be removably carried on the wheel base. A frame including a pair of upwardly extending portions is secured to the base. A pivot support extends between the upwardly extending portions of the frame and a pivot means is provided on the tank which cooperates with the support so that the tank is removably yet pivotally mounted onto the carriage base. The tank may be removed from the carriage or may be tilted about the pivot support to empty the contents therefrom.

As a result, a plurality of different size tanks may be supported and pivotally mounted on a single carriage in a readily detachable manner to permit substitution of different size tanks on the same carriage. This increases the versatility of the carriage and results in substantial manufacturing cost economies since the same carriage can be employed for a variety of tank sizes.

In narrower aspects of the invention, a carriage anti-tilt support means is provided which prevents tipping of the carriage during the tilting and tank dumping or emptying operation. Also, provision is made for power cord storage on a pair of arm assemblies carried by the handle, at least one of the arms being rotatable relative to the handle to permit the cord to be wrapped around the arms yet easily released by simple rotation of the arm.

DETAILED DESCRIPTION OF THE PREFERRED EMBODIMENT

Figure 1:
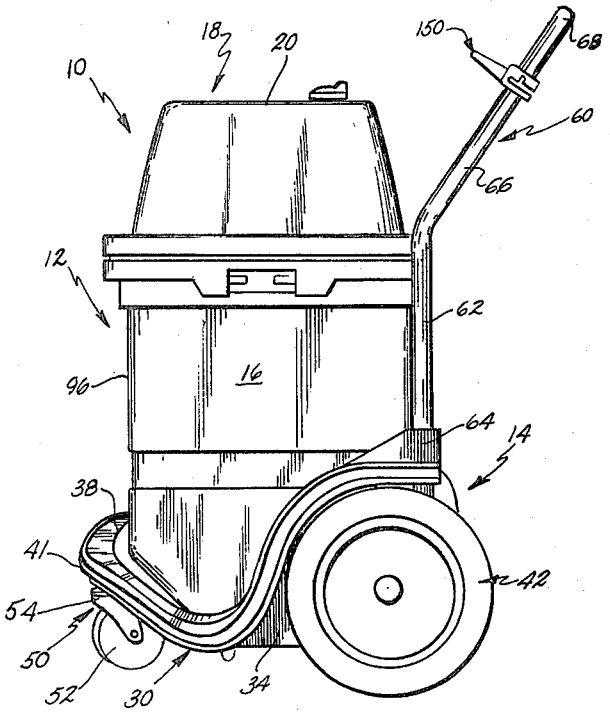
FIG. 1 is a side, elevational view of the unique vacuum cleaning apparatus in accordance with the present invention.

The preferred embodiment of the unique vacuum cleaning apparatus in accordance with the present invention is illustrated in the drawings and generally designated 10. The apparatus includes a vacuum cleaning device 12 and a carriage generally designated 14. The vacuum cleaning device includes a tank 16 within which debris and/or liquid is collected. As discussed below, the carriage will pivotally support a plurality of or family of tanks 16. Supported on top of the tank 16 is a suction head 18. The suction head 18 includes a housing 20 within which is mounted an electric motor and blower unit.

Figure 2:
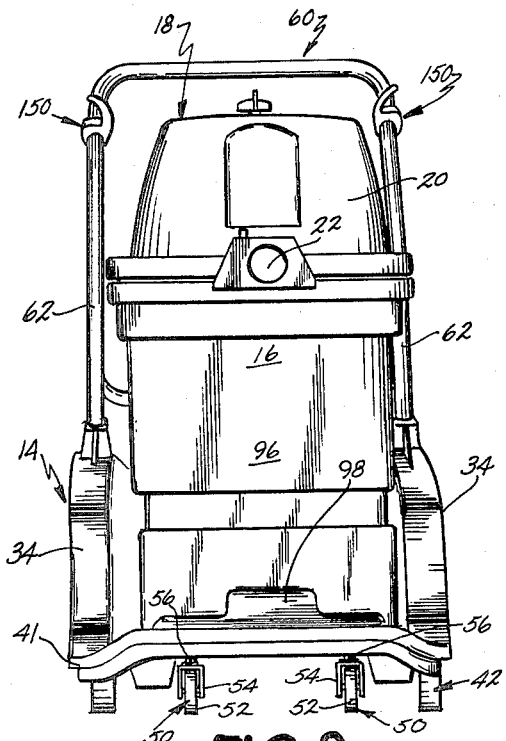
FIG. 2 is a front, elevational view of the unique vacuum cleaning apparatus.

As best seen in FIG. 2, the suction head 18 is provided with a suitable inlet opening 22. A suitable hose is connected to the inlet opening 22 at one end and to a suction implement at the other end. The suction head 18, in a conventional fashion, produces a suction in the hose to draw debris and/or liquid into the collection tank 16.

The tank 16 is preferably a molded, plastic item which is dimensioned to be supported on and received within a recess formed as part of the carriage 14. As best seen in FIGS. 1–3 and 6, the carriage 14 includes a base 30 defining a peripheral platform 32 upon which the tank rests, sidewalls 34, a rear wall 36 and an upwardly sloping, front wall 38. The platform portion 32 is defined by a ledge or flange and surrounds the periphery of an aperture 40. A rubber bumper strip 41 is secured to the periphery of the carriage.

Figure 7:
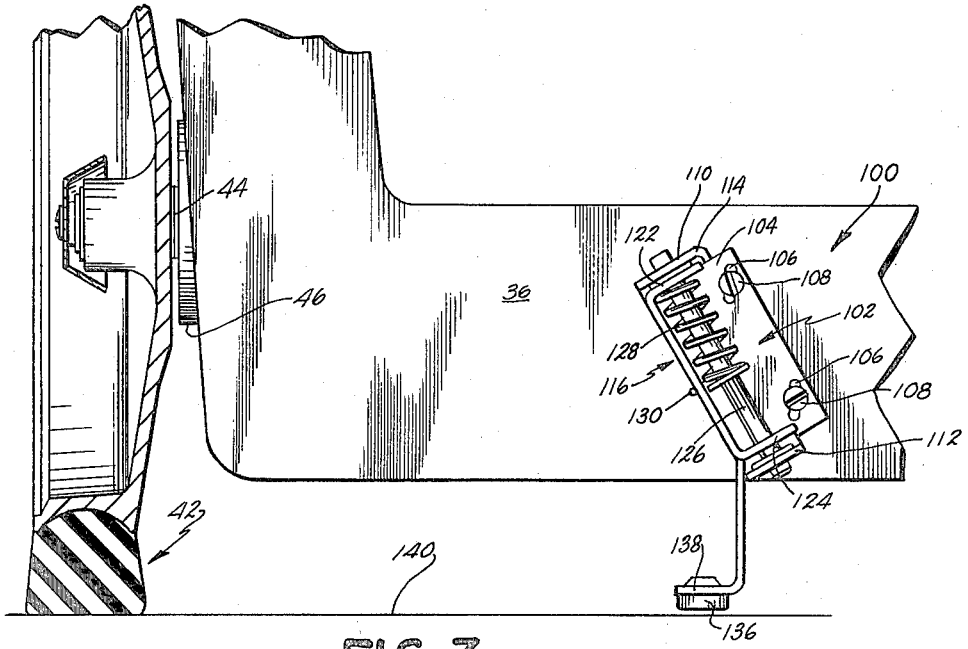
FIG. 7 is a fragmentary, partially sectioned, rear elevational view of the carriage.

Rotatably supported on a carriage 14 adjacent to yet forwardly of the rear wall 36 are a pair of ground engaging wheels 42. As best seen in FIG. 7, the ground engaging wheels 42 are rotatably mounted by suitable bearing assemblies on stub-shafts or axles 44. The axles 44 are received within bosses 46 formed integral with the base 30 of the carriage 14. The front of the carriage is supported by a pair of caster wheel assemblies 50 with each wheel 52 supported between yokes 54. The yokes 54 are pivotally mounted to the lower surface of the forward wall 38 by suitable shafts 56 in a conventional fashion. The carriage has been illustrated with a pair of rear ground engaging wheels 42 and a pair of front caster wheels 50. It is preferred that this form of wheel arrangement be employed to increase the stability of the carriage and vacuum cleaner over that which would be provided from a "tricycle" arrangement. A pair of rear ground engaging wheels and a single front caster wheel could, however, be employed to provide the wheel support for the carriage base 30.

Figure 3:
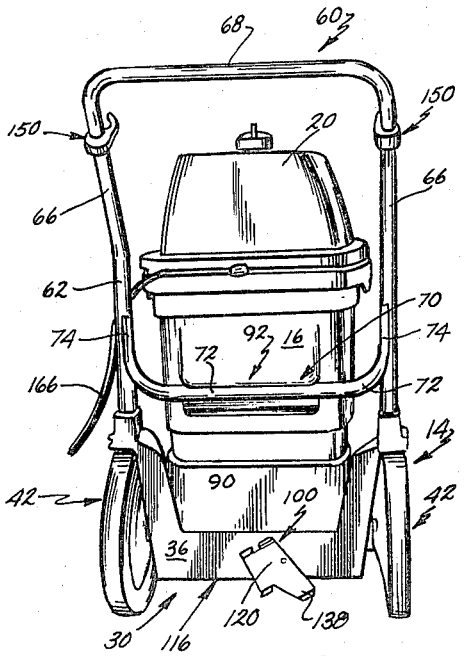
FIG. 3 is a rear, elevational view thereof.
Figure 5:
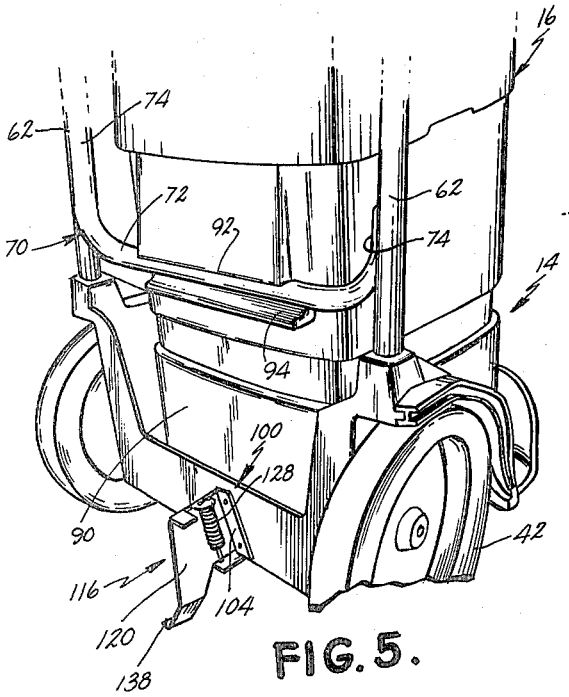
FIG. 5 is a rear, perspective, elevational view of the present invention showing the unique anti-tilt assembly secured to the carriage.

As best seen in FIGS. 1, 3 and 5, a generally U-shaped angled, handle frame 60 is secured to the base 30 of the carriage. The handle 16 includes upwardly extending portions 62, the lower ends of which are received within bosses 64 preferably formed integral with the base 30. The bosses 64 are positioned on opposite sides of the carriage 30. The portions 62 extend generally vertically upwardly and are formed integral with angled portions 66. The angled portions 66 join to a cross portion 68 and together therewith define an operator control handle. An operator is able to push or pull the carriage 30 by gripping the portion 66 or the cross portion 68 of the handle frame. The vertical portions 62 of the handle frame lie in a plane which is perpendicular to the sidewalls 34 of the carriage base 30.

Extending between the upwardly extending portions 62 of the handle, as best seen in FIGS. 3 and 5, is a cross member or pivot support bar 70. In the presently preferred embodiment, the pivot support bar 70 is a generally U-shaped member including an elongated base 72 and legs 74. The pivot support 70 may be fabricated from circular tubing with the legs 74 cut through to a semi-circular cross section having a radius equal to the outer radius of the portions 62 of the frame. The legs 74 are then secured to the frame portions 62 by any suitable means such as bolt fasteners or by spot welding. The bar 70 will pivotally support a family of different size tanks.

Figure 4:
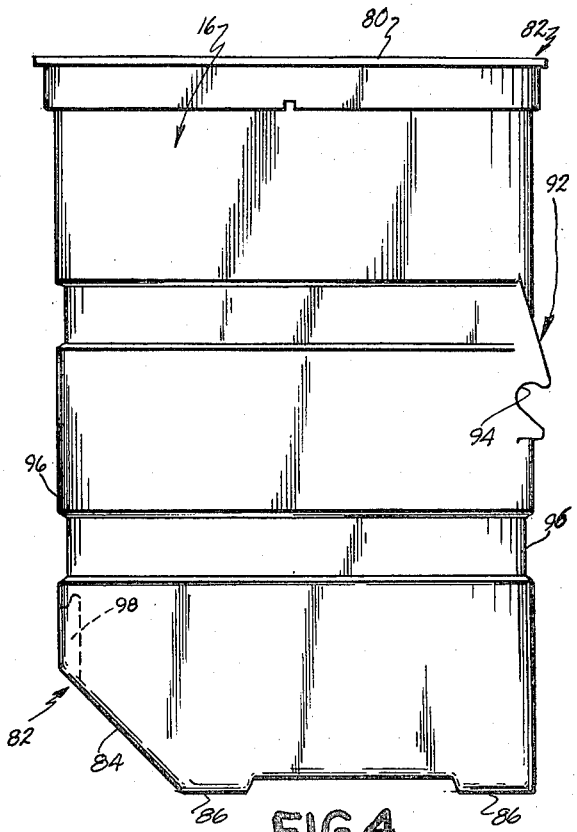
FIG. 4 is a side, elevational view of the unique collection tank incorporated in the subject vacuum cleaning apparatus.
Figure 6:
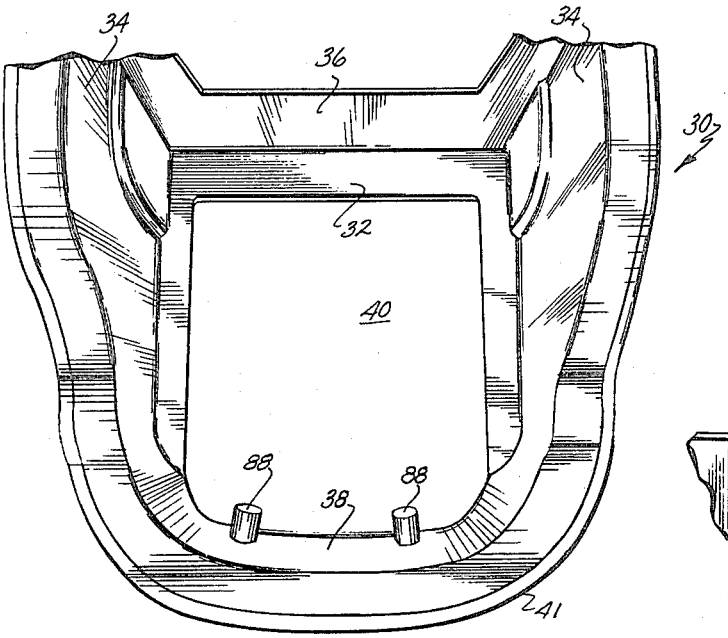
FIG. 6 is a fragmentary, top, perspective view of the carriage with the tank removed.

As best seen in FIG. 4, the collection tanks 16, only one size of which is shown, each have a generally semi-cylindrical shape including an open end 80 at which is formed a peripheral upwardly extending shoulder 82 upon which the suction head 20 is supported. The base portion 82 of the tank includes an angled, upwardly sloping wall 84 and a pair of transversely extending, molded feet 86. The lower end or the base 82 of the tank 16 is configured to rest on the platform 32 of the carriage 30 with the front wall 84 extending generally parallel to the angled, front wall 38 of the carriage. As seen in FIG. 6, a pair of rubber bumpers 88 are secured to the front wall 38 of the carriage. These bumpers abut against the front wall 84 of the tank 16 and assist in holding the tank within the recess defined by the carriage on the platform and resiliently bias the tank 16 so that the rear wall 90 thereof will abut against rear wall 36 of the carriage 30.

The rear wall 90 of the tank is generally planar in shape and includes thereon a pivot means 92. The pivot means 92 is preferably molded integral with the tank and defines a downwardly opening, angled, semi-circular groove 94. As seen in FIGS. 3 and 5, the semi-circular groove 94 is dimensioned to slip onto, receive and partially encircle portion 72 of the pivot support bar 70. The distance from the bottom surface of the foot 86 to the groove 94 is standardized for the various size tanks which may be positioned on the carriage. For example, the distance from the bottom of the tank to the groove 94 would be the same whether the tank is a 40 liter tank or a 50 liter tank. By so constructing the various size tanks with the uniformly positioned groove 94, they may all be mounted on the same carriage.

As should now be readily apparent, the tank 16 is supported on the carriage by placing the base portion 82 thereof within the recess defined by the carriage 30 and slipping the rod portion 70 into the semi-circular groove 94. Since the groove 94 opens downwardly, the tank may be pivoted about the bar portion 70 between the vertical portion 62 of the handle frame to dump the contents therefrom. As best seen in FIG. 2, the tank front wall 96 is molded with a recess 98. The recess 98 in conjunction with the front wall 96 defines a handle or gripping area which permits an operator to grip the tank at the forward wall thereof and rotate it or pivot it about the pivot support rod 70. In order to dump the liquid contents from the tank, the operator need merely remove the suction head 20 from the top of the tank, grasp the tank at the handle portion or recess 98 and pivot it in a clockwise direction when viewed in FIG. 1 to dump the contents therefrom.

With prior tilting or pivotal tank and carriage combinations, problems have been experienced with the dumping operation since when the tank is rotated about a pivot point, the center of gravity for the tank/carriage combination would shift. When this happens, the carriage will usually tilt or rotate about the wheels and turn over. Heretofore, in order to prevent this tipping of the carriage itself, the operator has been required to place weight on the front of the carriage. Typically, the operator has placed one foot on the front edge of the carriage during the dumping operation.

Figure 8:
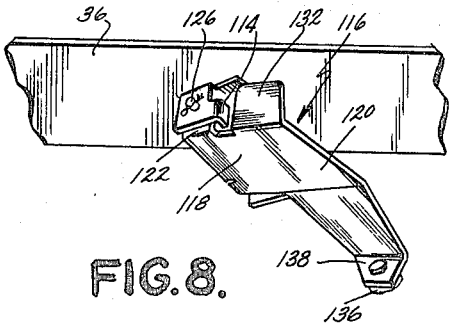
FIG. 8 is a fragmentary, perspective view of the carriage showing the anti-tilt assembly in the stored position.

In order to prevent this undesirable tipping of the carriage and tank during dumping, a unique anti-tilt support is provided. In the embodiment illustrated in FIGS. 3, 5 and 7, the anti-tilt support 100 includes a bracket 102 secured on an angle from the vertical to the outer surface of the rear wall 36, generally centrally thereof. The bracket 102 includes a mounting plate portion 104 having vertical adjustment slots 106 through which suitable fasteners 108 extend to secure the bracket to the rear wall 36. Formed integral with the bracket 102 are a pair of outwardly extending, generally parallel, spaced, tabs 110 and 112. The upper tab 110 includes a downwardly extending detent tab or portion 114. Pivotally supported between the tabs 110 and 112 is an anti-tilt member 116 which includes a main body portion 118 and a depending, angled foot portion 120. The main body portion 118 is provided with spaced, parallel, inwardly directed pivot tabs 122 and 124. A pivot pin 126 extends through the tabs 112, 124 and 122, 110 to pivotally support the anti-tilt member 116 on the bracket 102. A coil spring 128 encircles the pivot pin 126. One free end, preferably the upper end, of the coil spring 128 engages the bracket 102. The other free end 130 of the coil spring engages the main body portion 118 of the anti-tilt member 116. As a result, the coil spring 128 biases the anti-tilt member 116 towards the rear wall 36 of the carriage as seen in FIG. 8. The main body portion 118 of the member 116 is provided with a stop tab 132 which will engage the rear wall 36 of the carriage when the anti-tilt member 116 is in the stored position. Secured to the foot 120 of the anti-tilt member 116 is a rubber bumper 136. The rubber bumper 136 is received within an aperture formed in a tab portion 138 of the foot.

As seen in FIG. 7, the bracket 102 is positioned on a rear wall 36 and the anti-tilt member 116 is dimensioned and angled so that the bumper 136 is parallel with the floor or ground surface 140 upon which the carriage rides. When the anti-tilt member 116 is rotated outwardly away from the rear wall 36 from the first or stored position to a second or operating position, the tab 122 will cam against the inner face of the tab 114 of the bracket 102. As the angle through which the member rotates approaches 90°, the flat transverse edge of the tab 122 will be approximately parallel with the tab portion 114. The tab portion 114 engages this transverse edge to hold the member 116 in the operating position against the bias of the coil spring 128. The cooperating tabs provide an over center, spring biased type action for the anti-tilt member 116.

The operation of the anti-tilt assembly 100 should now be readily apparent. When the operator desires to tilt the tank 16 or pivot it about the support bar 70 to empty its contents, he will shift or pivot the member 116 outwardly from the rear wall 36 into the operating position shown in FIGS. 5 and 7. The operator will then remove the suction head 20 and grasp the forward handle or recess 98 of the tank and lift the tank so as to pivot it about the bar 70. The rubber bumper 136 carried on the foot 120 will engage the floor surface and in conjunction with the rear ground engaging wheels 42 provide a three-point support for the carriage. The rubberized bumper 136 prevents slipping of the foot 120 relative to the floor surface. The anti-tilt member 116 prevents rotation of the carriage about the axles 44 of the ground engaging wheels 42 during the dumping operation. This feature, therefore, eliminates the need for the operator to constantly place weight on the forward edge of the carriage during the dumping operation. The anti-tilt member is simple and easy to operate and eliminates a problem which has heretofore existed.

With the embodiment just described, it is preferred that the anti-tilt member 116 be dimensioned so that the bumper 136 just clears the floor surface prior to filling of the tank. The carriage will rotate slightly on axles 44 during dumping to place it in contact with the floor. The rubber bumper frictionally engages the floor and prevents slipping. This permits the carriage to be easily moved even when the anti-tilt support is in the operating position. A spacing of the bumper when in the operating position from the floor surface of 0.09 inch has been found to be acceptable.

Figure 12:
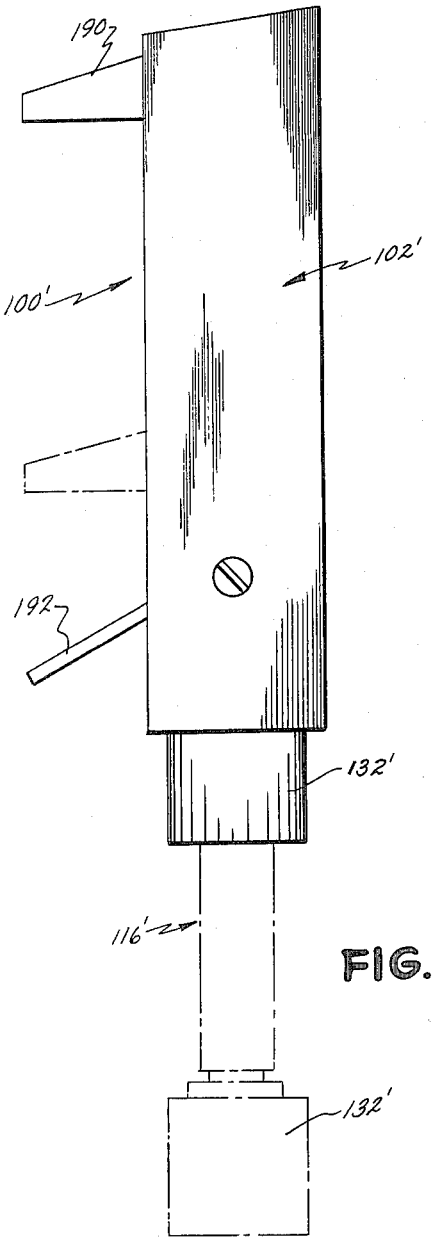
FIG. 12 is a side, elevational view of the presently preferred anti-tilt assembly.
Figure 13:
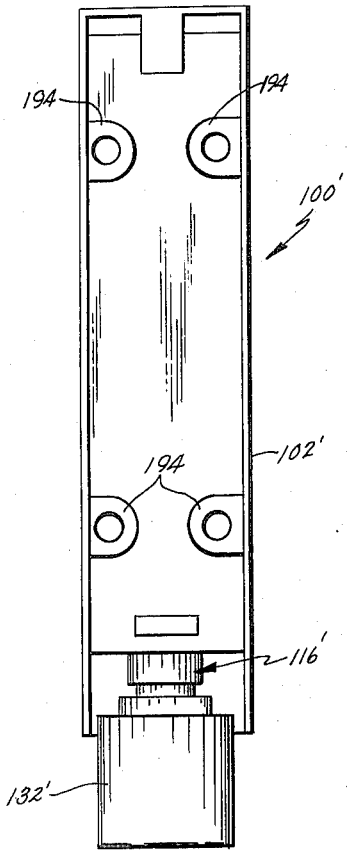
FIG. 13 is a rear elevational view of the anti-tilt assembly of FIG. 12.

FIGS. 12 and 13 illustrate an alternative embodiment generally designated 100' of the above described anti-tilt assembly 100. In this embodiment, a conventional door stop is employed. Embodiment 100' includes a support bracket 102' in the form of a channel-shaped housing. Movably mounted within the bracket 102' is an anti-tilt member 116'. The anti-tilt member is a vertically shiftable plunger-like member movable from an inoperative position shown in solid lines in FIG. 12 to an operative position shown in phantom in FIG. 12. A tab 190 is secured to the plunger or member 116' and the tab 190 extends outwardly from the front face of the bracket 102'. A latch 192 is also included to hold the member 116' in the operating position. The lower end of the member 116' carries a rubberized bumper or cap 132' which serves the same purpose as bumper 132 of the embodiment of FIGS. 3, 5 and 7.

The assembly 100' is secured to the rear wall 36 of the carriage by suitable fasteners passing through mounting tabs 194 (FIG. 13). The assembly 100' is positioned at approximately the center of the rear wall and at a height relative to the floor surface so that when in the operating position, the bumper 132' touches or almost touches the floor surface. The specific assembly 100' illustrated is a commercially available item and is sold by Dorma Baubeschlag Co., Ennepetal, Germany under the designation #360 Teleskop-Turfesteller (Door-Stop).

The operation of embodiment 100' should now be readily apparent. When it is desired to tilt the tank, the operator will shift member 116' by pushing down on tab 190 with his foot until member 116' is latched in the operating position. The tank may now be tilted in the manner described above and the assembly 100' in conjunction with the carriage prevents upturning of the carriage.

Figure 9:
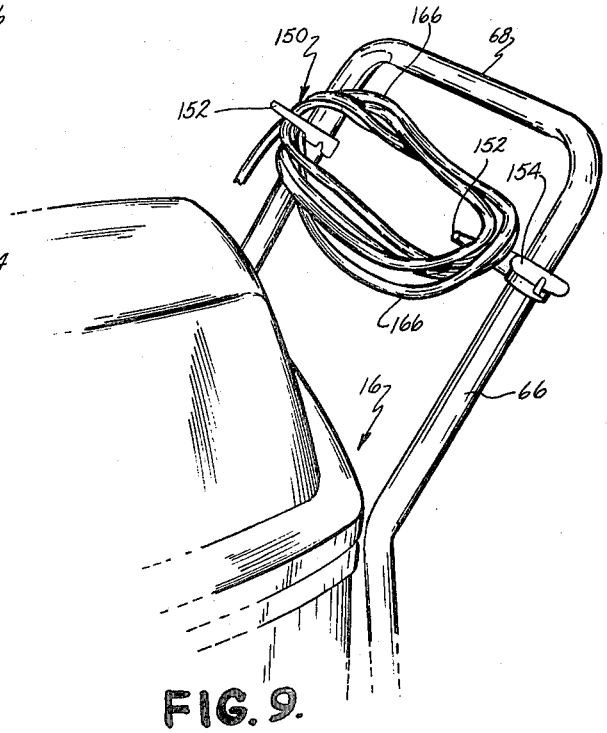
FIG. 9 is a fragmentary, perspective view showing a unique power cord storage means.
Figure 11:
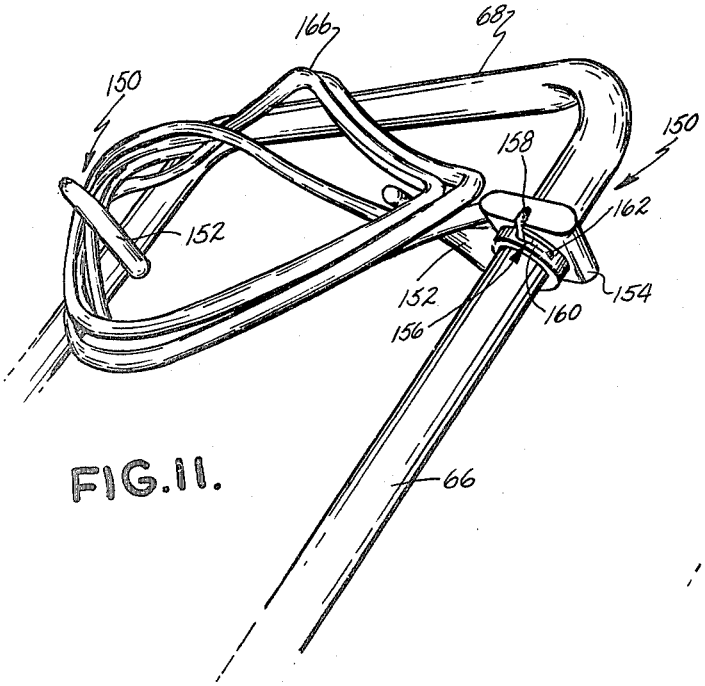
FIG. 11 is a side, elevational view of the power cord storage means.
Figure 10:
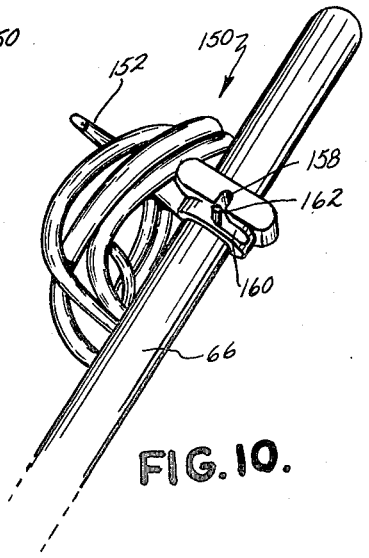
FIG. 10 is a perspective view showing the power cord storage means in the release position.

As best seen in FIGS. 9, 10 and 11, a unique power cord storage means is provided on the angled portions 66 of the handle frame 60. Mounted on the handle portion 60 are a pair of arm assemblies 150. Each arm assembly 150 includes an outwardly extending arm or finger 152 and a hub portion 154. The hub portion defines a through bore having a diameter substantially equal to the outer diameter of the tube portions 66 of the handle frame. As best seen in FIGS. 10 and 11, the hub portion 154 is provided with a generally L-shaped slot 156. One leg 158 of the slot extends generally parallel to the longitudinal centerline of the tube portion while the other leg 160 extends at a right angle to the longitudinal centerline of the tube portions 66. A pin 162 extends radially outwardly from the tube portion 66 and is received within the slot 156. It is presently preferred that the hub portion 154 be fabricated as a two-piece member held together by suitable bolts or fasteners to permit it to be assembled on the tube portions 66. Initially, both of the arm assemblies 152 are positioned on the tube portions 66 so that the arms 152 extend parallel to each other and generally perpendicular to the plane of the handle portion 66. When in this position, the pin 162 will be seated within the short leg section 158 of the slot 156. Power cord 166 may then be wrapped around the arms 152 for storage. When the machine is to be used, the operator will shift one of the arm assemblies 150 towards the handle portion 68 so that the pin 162 will ride out of the leg portion 158 and into the leg portion 160. The arm assembly 150 may then be rotated inwardly towards the other arm assembly. As seen in FIG. 11, this releases the power cord 166 so that it may be removed from the machine and connected to a suitable outlet.

Therefore, the unique vacuum cleaner apparatus in accordance with the present invention including the plurality of different size tanks 16 and the carriage 14 easily and readily permits a tank to be supported on the carriage by merely lowering it so that the base portion of the tank is received within the recess defined by the carriage and a support bar 70 is received within the grooved portion 94 on the back of the tank. The anti-tilt means 100 permits dumping of the contents of the tank without tipping of the carriage. The carriage and tank pivot means eliminates the need for a pivot assembly which permanently or semi-permanently mounts the tank to the carriage. This permits tanks of different sizes to be substituted and supported on the carriage. The manufacturer need therefore supply only one carriage size and a plurality of different tank sizes to meet the needs of the operator and/or purchaser of the cleaning apparatus.

It is presently preferred that the tank 16 be fabricated from a high density, linear polyethylene material by a rotational molding process. An ultra-violet additive may be added to the polyethylene which preferbly has a 0.96 density and a flex stiffness of 150,000 to 160,000 PSI. Also, it is presently preferred that the carriage base 30 be fabricated from aluminum as a permanent mold type casting. The power cord storage arms 150 may be fabricated from any suitable plastic and/or metal material. The bracket and foot of the anti-tilt support 116 are preferably fabricated from 10 gauge cold rolled sheet steel. The coil spring 128 may be fabricated from 17-7 PH stainless steel, heat treated for one hour at 900° F. to obtain a 292,000 to 320,000 PSI tensile strength. The spring would have 14 total coils and may be fabricated from wire having a diameter of 0.080 inches. Preferably, the spring would exert a torque in the initial or storage position of 3.78 inch pounds and a torque in the final or operating position of 7.27 inch pounds and would have a total free length of 2 inches. In compression, the spring would have 12 active coils and a spring rate of 25 lbs/in.

In view of the above description, those of ordinary skill in the art will undoubtedly become aware of various modifications to the unique vacuum cleaning apparatus disclosed which would not depart from the inventive concepts employed therein. Therefore, it is expressly intended that the above description should be considered as that of the preferred embodiment. The true spirit and scope of the present invention will be determined by reference to the appended claims.

The embodiments of the invention in which an exclusive property or privilege is claimed are defined as follows.

1. A vacuum cleaning apparatus of the type including a suction head, said apparatus comprising:

a wheeled base defining a platform;

a collection tank including a base and being adapted to removably carry said suction head, the base of said tank being received on and supported by said wheeled base;

a frame including a pair of portions extending upwardly from said wheeled base adjacent the rear thereof, said portions being joined at their top ends by a transverse member to define a handle;

a pivot support rod extending between and secured to said upwardly extending frame portions; and pivot means on the rear of said tank dimensioned to receive said pivot support rod for removably mounting said tank to said wheeled base and said frame, for permitting said tank to be removed from said support rod by lifting said tank, and for permitting said tank and said pivot means to rotate about said pivot support rod so that said tank may be pivoted about said rod to dump the contents therefrom yet readily removed from the carriage by simply lifting the tank upwardly, said pivot means defining a transverse downwardly opening groove dimensioned to slip onto and partially encircle said support rod and wherein said tank includes a front wall having a hand recess for permitting manual grasping of said tank to effect tank pivoting.

2. A vacuum cleaning apparatus of the type including a suction head, said apparatus comprising:

a wheeled base defining a platform;

a collection tank including a base and being adapted to removably carry said suction head, the base of said tank being received on and supported by said wheeled base;

a frame including a pair of portions extending upwardly from said wheeled base adjacent the rear thereof, said portions being joined at their top ends by a transverse member to define a handle;

a pivot support rod extending between and secured to said upwardly extending frame portions;

pivot means on the rear of said tank dimensioned to receive said pivot support rod for removably mounting said tank to said wheeled base and said frame for permitting said tank to be removed from said support rod by lifting said tank, and for permitting said tank and said pivot means to rotate about said pivot support rod so that said tank may be pivoted about said rod to dump the contents therefrom yet readily removed from the carriage by simply lifting the tank upwardly; and anti-tilt means mounted on the rear of said base for preventing tilting of said base when said tank is pivoted to empty the contents therefrom.

3. A vacuum cleaning apparatus as defined by claim 2 wherein said tilting preventing means comprises:

a bracket secured to said base;

an anti-tilt support member including a foot extending downwardly therefrom; and means for pivotally mounting said anti-tilt support means to said bracket, said anti-tilt member being pivotable from a first stored position to a second operating position, said foot being dimensioned to contact the ground surface when in said operating position and during tank pivoting to prevent tilting of said wheeled base during pivoting of said tank.

4. A vacuum cleaning apparatus as defined by claim 3 wherein said bracket includes a detent tab resiliently holding said support member in said operating position and wherein said pivotal mounting means comprise:

a pivot pin extending through said brackets and said support member; and a spring means engaging said support member for biasing said member to the storage position.

5. A carriage for supporting a plurality of different size vacuum cleaning apparatus collection tanks, the vacuum cleaning apparatus being of the type including an electrically driven suction device having a power cord, said suction device being supportable on each of said tanks and all of said tanks including a transversely extending pivot means on the rear thereof defining an outwardly and downwardly opening groove and a tank base having an upwardly angled front portion, said pivot means being positioned the same distance from the base of each of the tanks, said carriage comprising:

a carriage base defining a platform dimensioned to support said tanks;

a pair of ground engaging wheels positioned on said carriage base adjacent yet spaced from the rear transverse edge of said base;

a pair of spaced members extending upwardly from opposite sides of said carriage base; and a pivot support rod extending between said spaced members and non-rotatably secured to said spaced members, said rod dimensioned to be received in the groove of said pivot means of each of said tanks and positioned vertically above said platform so that each of the tanks rests on said platform, said carriage base further including an upwardly sloping front wall, a vertical rear wall and a pair of spaced sidewalls interconnecting said front and said rear walls; and at least one resilient tank bumper mounted on said upwardly sloping front wall of said carriage base, said bumper dimensioned and angled with respect to said upwardly sloping front wall to engage the tank base forward portion biasing a tank on said platform against said rear wall.

6. A carriage for supporting a plurality of different size vacuum cleaning apparatus collection tanks, the vacuum cleaning apparatus being of the type including an electrically driven suction device having a power cord, said suction device being supportable on each of said tanks and all of said tanks including a transversely extending pivot means on the rear thereof defining an outwardly and downwardly opening groove, said pivot means being positioned the same distance from the base of each of the tanks, said carriage comprising:

a carriage base defining a platform dimensioned to support said tanks;

a pair of ground engaging wheels positioned on said carriage base adjacent yet spaced from the rear transverse edge of said base;

a pair of spaced members extending upwardly from opposite sides of said carriage base;

a pivot support rod extending between said spaced members and non-rotatably secured to said spaced members, said rod dimensioned to be received in the groove of said pivot means of each of said tanks and positioned vertically above said platform so that each of the tanks rests on said platform; and anti-tilt means secured to said carriage for providing a three-point support with said ground engaging wheels to prevent tipping of said carriage during pivoting of one of said tanks on said pivot rod.

7. A carriage as defined by claim 6 wherein said anti-tilt means comprises:

a bracket secured to said base;

an anti-tilt support member including a foot extending downwardly therefrom; and means for pivotally mounting said anti-tilt support means to said bracket, said anti-tilt member being pivotable from a first stored position to a second operating position, said foot being dimensioned to contact the ground surface when in said operating position and during tank pivoting to prevent tilting of said wheeled base during pivoting of said tank.

8. A carriage as defined by claim 7 wherein said bracket includes a detent tab resiliently holding said support member in said operating position and wherein said pivotal mounting means comprise:

a pivot pin extending through said bracket and said support member; and a spring means engaging said support member for biasing said member to the storage position.

9. A carriage as defined by claim 8 wherein said spring means is a coil spring, one free end of which engages said bracket and the other free end of which engages said anti-tilt support member.

10. A carriage as defined by claim 5 wherein said platform is defined by a ledge extending inwardly from said walls around the inner periphery of said carriage base.

11. A carriage as defined by claim 5 further including a pair of front caster wheels mounted to said carriage front wall.

12. A carriage as defined by claim 11 further including power cord storage means on said spaced member for storing the power cord of said suction head.

13. A carriage as defined by claim 12 wherein said power cord storage means comprises:

a first pin extending radially outwardly from one of said spaced members;

an arm rotatably supported on said one of said spaced members, said arm including a hub portion defining an L-shaped slot within which said pin extends; and another arm secured to the other of said spaced members, said arm being rotatable to a first position so that said pin may be positioned in one leg of said slot and the power cord may be wrapped around said arms, and said cord being released by shifting said hub to place said pin in the other leg of said slot and rotating said arm towards said other arm.

14. A collection tank for a vacuum cleaning device, said tank being adapted for use with a carriage having a carriage base defining a tank platform, upwardly extending, spaced frame members and a pivot support rod extending between said spaced frame members, said tank comprising:

a front wall;

sidewalls;

a rear wall joining said sidewalls;

a base; and pivot means extending transversely of said rear wall for permitting said tank to be pivoted about said support rod for dumping the contents therefrom and for permitting said tank to be lifted from the carriage, said pivot means defining a transverse, downwardly opening groove dimensioned to slip onto and partially encircle said support rod and said pivot means being integral with said tank, said front wall defining a hand recess adjacent said base for permitting manual grasping of said tank to effect tank pivoting.

15. A vacuum cleaning system, comprising:

a suction device;

a vacuum cleaning apparatus collection tank, said tank supporting said suction device, said collection tank including a base and a vertically spaced, transversely extending pivot member defining a rearwardly and downwardly opening groove;

a carriage including a carriage base defining a platform dimensioned to support said tank, a pair of ground engaging wheels positioned on said carriage base adjacent yet spaced from the rear transverse edge of said carriage base, a pair of spaced members extending upwardly from opposite sides of said carriage base, and a pivot support means extending between said spaced members for pivotally and detachably supporting said tank and being dimensioned to be disposed within said groove of said pivot member, and for freely, pivotally and readily detachably supporting any one of a plurality of different size vacuum cleaning apparatus collection tanks each of which has a base and a transversely extending pivot member spaced the same distance from each base of each of said tanks as said pivot member of said a tank is spaced from its base.

16. A vacuum cleaning system, comprising:

a suction device;

a vacuum cleaning apparatus collection tank, said tank supporting said suction device, said collection tank including a transversely extending pivot member defining a rearwardly and downwardly opening groove;

a carriage including a carriage base defining a platform dimensioned to support said tank, a pair of ground engaging wheels positioned on said carriage base adjacent yet spaced from the rear transverse edge of said carriage base, a pair of spaced members extending upwardly from opposite sides of said carriage base, and a pivot support rod extending between said spaced members, said rod dimensioned to be received in the groove of said pivot member of said tank, and anti-tilt means secured to said carriage for providing a three-point support in conjunction with said ground engaging wheels to prevent tipping of said carriage during pivoting of said tank on said pivot support rod.

17. A vacuum cleaning system as defined by claim 15 wherein said pivot member of said tank is integral with said tank and said tank includes a rear wall defining said pivot member.

18. A vacuum cleaning system, comprising:

a suction device;

a vacuum cleaning apparatus collection tank, said tank supporting said suction device, said collection tank including a transversely extending pivot member defining a rearwardly and downwardly opening groove;

a carriage including a carriage base defining a platform dimensioned to support said tank, a pair of ground engaging wheels positioned on said carriage base adjacent yet spaced from the rear transverse edge of said carriage base, a pair of spaced members extending upwardly from opposite sides of said carriage base, and a pivot support rod extending between said spaced members, said rod dimensioned to be received in the groove of said pivot member of said tank, said collection tank including a front wall, sidewalls and a rear wall joining said sidewalls, and wherein said front wall defines a hand recess adjacent said carriage base for permitting manual grasping of said tank to effect tank pivoting.

19. A vacuum cleaning system as defined by claim 18 wherein said pivot member is defined by said tank rear wall and comprises a transverse, downwardly opening groove dimensioned to slip onto and partially encircle said support rod, said pivot member being integral with said tank.

20. A carriage as defined by claim 5 further including anti-tilt means secured thereto for providing a three-point support with said ground engaging wheels to prevent tipping of said carriage during pivoting of one of said tanks on said pivot rod.

* * * * *